US006607802B2

(12) United States Patent
Matsuuchi et al.

(10) Patent No.: US 6,607,802 B2
(45) Date of Patent: Aug. 19, 2003

(54) METHOD FOR JOINING TWO PARTS AND A UNIT OF JOINED PARTS JOINED BY THE SAME

(75) Inventors: Seiji Matsuuchi, Chiba-Ken (JP); Mitsuo Takahashi, Saitama-Ken (JP); Kiyomi Uematsu, Tokyo (JP); Toshio Takahashi, Tokyo (JP)

(73) Assignee: Kioritz Corporation, Tokyo (JP)

( * ) Notice: Subject to any disclaimer, the term of this patent is extended or adjusted under 35 U.S.C. 154(b) by 113 days.

(21) Appl. No.: 09/818,501

(22) Filed: Mar. 28, 2001

(65) Prior Publication Data

US 2001/0025408 A1 Oct. 4, 2001

(30) Foreign Application Priority Data

Mar. 29, 2000 (JP) ..... 2000-091786

(51) Int. Cl.[7] ..... B32B 3/10
(52) U.S. Cl. ..... 428/57; 220/689; 428/174
(58) Field of Search ..... 428/57, 34.1, 174; 220/677, 682, 689

(56) References Cited

U.S. PATENT DOCUMENTS 3,151,767 A * 10/1964 Nakata ..... 220/689

* cited by examiner

*Primary Examiner*—Alexander S. Thomas
(74) *Attorney, Agent, or Firm*—Nixon Peabody LLP; Donald R. Studebaker

(57) ABSTRACT

The present invention is directed to a method for joining two parts together and the unit derived therefrom. The method comprises the steps of mating a first flange portion extending along an entire periphery of a first part with a second flange portion extending along an entire periphery of a second part; overfolding a margin portion extending along an outer edge of the second flange portion to join the first part and the second part; a linear ridge being formed on at least one of the first flange portion, the second flange portion and the margin portion, the linear ridge extending along an entire periphery of the at least one portion and extending toward the first flange portion, the second flange portion or the margin portion which is opposed to the linear ridge in the overfolded state; and compressing the margin portion to plastically deform the linear ridge so as to form a seal between the two parts.

16 Claims, 5 Drawing Sheets

METHOD FOR JOINING TWO PARTS AND A UNIT OF JOINED PARTS JOINED BY THE SAME

FIELD OF THE INVENTION

The present invention relates to a method for joining two parts to each other, more specifically, to a method which provides a joined portion with a high level of air tightness.

DESCRIPTION OF THE PRIOR ART

Conventionally, it has been widely practiced to make two parts by press molding a sheet of steel and join them together, for example, in a manufacturing process of an exhaust muffler used for a small internal combustion engine. As for the exhaust muffler, it is desirable for the joined portion thereof to have a high level of air tightness because a housing made of plastic which surrounds the exhaust muffler could melt due to exposure to high temperature exhaust gas and also the interior of the housing could become contaminated by the exhaust gas if an exhaust gas is leaked from the joined portion. Conventionally, many various measures have been applied to prevent a gas leak from the joined portion, including, for example, repeating the sealing process several times, applying a sealing agent to join surfaces facing each other, brazing an end portion, or inserting a packing material between joined surfaces.

However, those measures as described above have detrimental effects such as an increase in a number of steps in a manufacturing process which results in a cost increase therein.

Accordingly, an object of the present invention is to provide a method for providing a tightly sealed joined portion with a reduced number of operating steps and reduced costs without a reduction in quality. Further, it is also an object of the present invention to provide a unit comprising parts which are joined by the same method.

SUMMARY OF THE INVENTION

The above object of the present invention can be accomplished by a method for joining two parts together, the method comprising the steps of: mating a first flange portion extending along an entire periphery of a first part with a second flange portion extending along an entire periphery of a second part; overfolding a margin portion extending along an outer edge of the second flange portion to join the first part and the second part; providing a linear ridge being formed on at least one of the first flange portion, the second flange portion and the margin portion, the linear ridge extending along an entire periphery of the at least one portion and extending toward the first flange portion, the second flange portion or the margin portion which is opposite to the linear ridge in an overfolded state; and compressing the margin portion to plastically deform the linear ridge so as to form a seal between the two parts.

According to the present invention, the linear ridge is strongly compressed against the opposite surface to establish a sealing therebetween and a high level of air tightness can be obtained. Further, since in the present invention, the linear ridge is integrally formed on the part during the forming process thereof, only a overfolding and compressing steps are required to join them, that is, no additional steps and parts are not required. Accordingly, it makes it possible to simplify the operation and to reduce the cost. In addition, since the linear ridge is strongly compressed against the opposite surface, a reliable sealing is ensured along the entire periphery, thereby preventing any reduction in the resultant quality.

BRIEF DESCRIPTION OF THE DRAWINGS

FIGS. 4*a*–4*n* are enlarged partial cross-sectional views illustrating the joined portion, wherein FIG. 4*a* shows the portion before being joined, FIG. 4*b* shows the portion after joined in accordance with the present invention and FIGS. 4*c*–4*n* show the portions of alternative embodiments of the present invention.

DESCRIPTION OF THE PREFERRED EMBODIMENTS

With reference to the attached drawings, a preferred embodiment of a method for joining two parts and the parts to be joined by the same method according to the present invention shall be described in detail. It should be appreciated that, the present invention is applicable to various products that are manufactured by joining two parts together by a pressing process. However, for the purpose of illustration, the description in this embodiment is made with respect to joining parts of a muffler used for a small air-cooled type two-stroke cycle gasoline engine.

Figure 1:
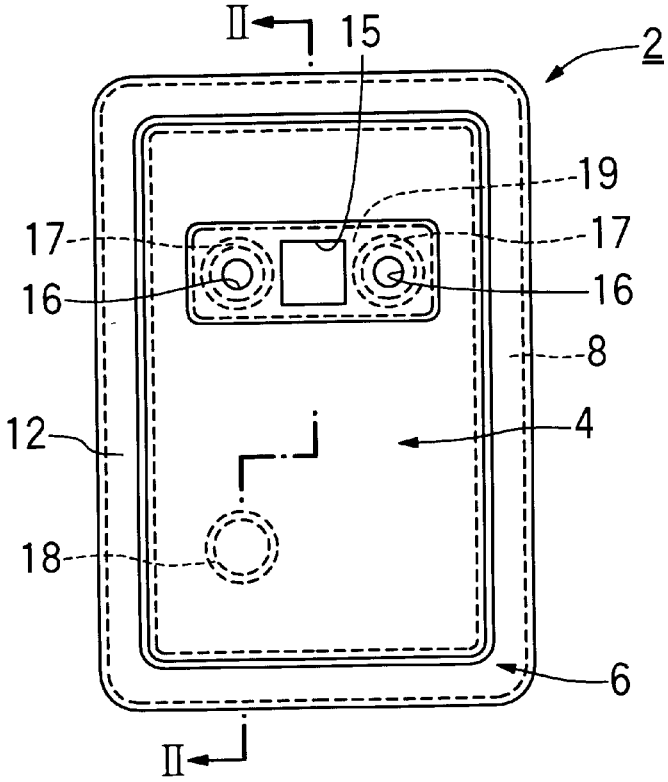
FIG. 1 is a side view of a muffler joined by the method in accordance with the present invention.
Figure 2:
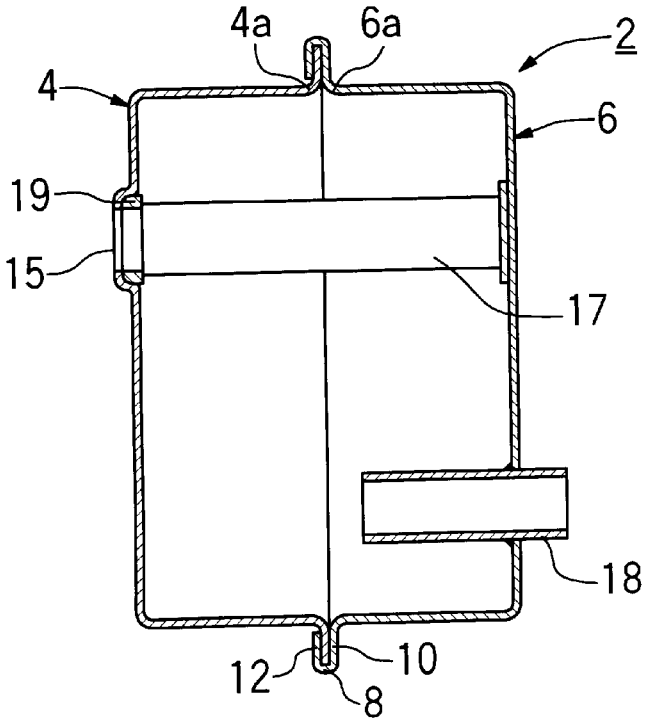
FIG. 2 is a longitudinal cross-sectional view of the muffler taken along a line II—II shown in FIG. 1.
Figure 3:
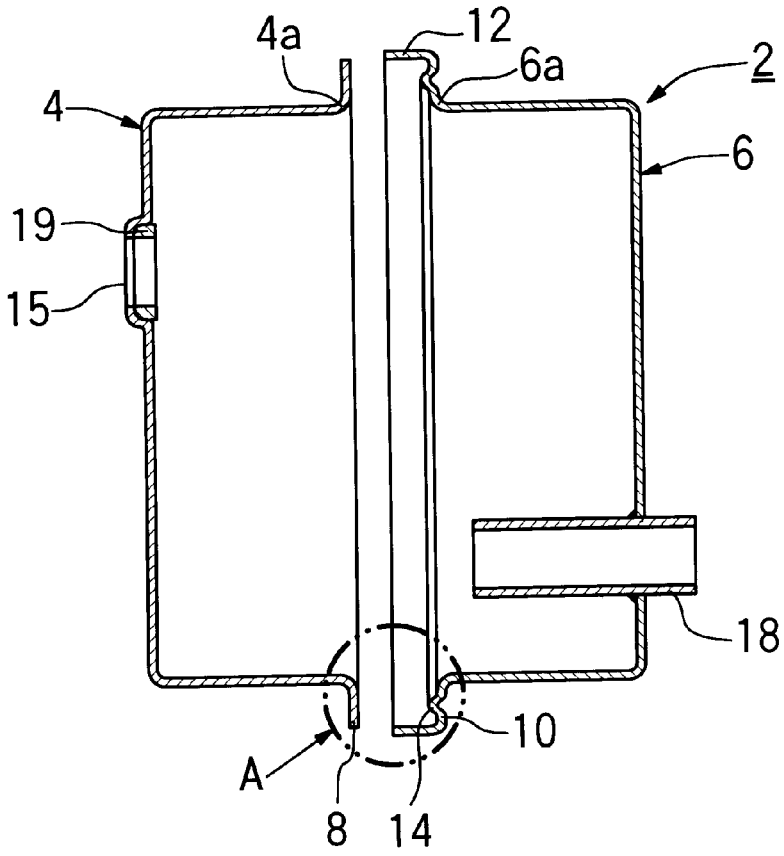
FIG. 3 is a longitudinal cross-sectional view illustrating two pieces of half components constituting the muffler before being joined in accordance with the present invention.

As can be seen from FIGS. 1 to 3, a muffler 2 of this embodiment comprises a first half 4 and a second half 6 formed into a concave shape by press molding a sheet of steel, respectively, so as to form a muffling space therein when they are joined to each other. The first half 4 and the second half 6 have a first flange portion 8 and a second flange portion 10, respectively, each of which extend along an entire periphery of an opening 4*a* or 6*a* thereof and are to be mated to each other. The first flange portion 8 and the second flange portion 10 have an overhang of substantially the same width. Further, the second half 6 has a margin portion 12 extending along an entire outer edge of the second flange portion 10. The margin portion 12 also has an overhang with approximately the same width as that of the first and the second flange portions 8 and 10.

Figure 4A:
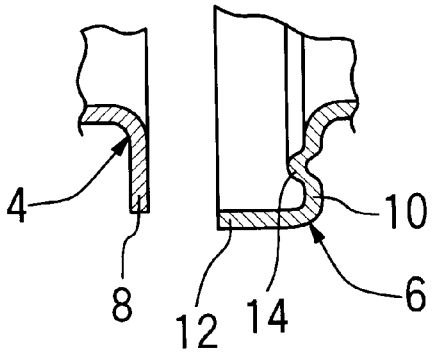

Furthermore, as apparent from FIGS. 3 and 4*a*, the second flange portion 10 is provided with a linear ridge or bead 14 projecting toward the first flange 8, which is to be pressed against the linear ridge 14 upon compression of the components. The linear ridge 14 extends from the second flange portion 10 continuously along the entire periphery of the opening 6*a* of the second half 6. Further, the linear ridge 14 is formed on the thin plate of the second flange portion 10 in the form of in a wave shape when viewed in a cross-sectional view. More specifically, it is formed in a convex shape toward an opposing surface after joined and the back face thereof is formed in a concave shape so as to allow for plastic deformation of the linear ridge 14 when pressed by the opposite surface during a compression step.

Each of the first half 4 and second half 6 made of metal, for example, aluminum-alloy or steel, and is formed by an appropriate integral forming method, in which the linear ridge 14 is also formed concurrently during the integral forming process.

In the attached drawings, a reference numeral 15 indicates an exhaust gas inlet in communication with an exhaust port of an engine cylinder (not shown), 16 indicates a bolt through-hole for a bolt (not shown) for securing the muffler 2 to the engine cylinder, 17 indicates a reinforcing pipe which serves as a guide for the bolt, 18 indicates a tail pipe as an exhaust gas outlet, and 19 indicates a reinforcing plate for an attaching section.

Figure 4B:
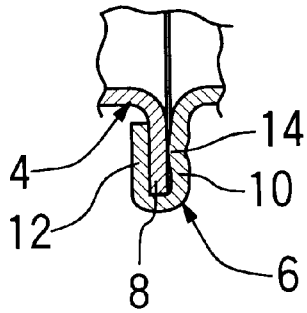

To assemble the muffler 2 in accordance with the present invention, at first, as shown in FIGS. 3 and 4*a,* the concave portions of the first half 4 and the second half 6 are oriented so that the openings 4*a* and 6*a* face to each other and the first flange portion 8 and second flange portion 10 are mated with each other. Then, the margin portion 12 is overfolded and pressed into contact with a back surface of the first flange portion 8. FIGS. 1, 2 and 4*b* show the first half 4 and the second half 6 after being joined. As apparent from the observation of FIG. 4*b*, the linear ridge 14 is collapsed until it is plastically deformed and eventually it becomes nearly flat whereby the linear ridge 14 is strongly compressed against the opposite surface of the first flange portion 8 over the entire periphery thereof. As a result, the linear ridge 14 is sealingly engaged with the first flange portion 8.

According to the embodiment, since the linear ridge 14 is formed on the second flange portion 10, it ensures the sealing between the second flange portion 10 and the surface opposite thereto after being compressed. Therefore, the muffler 2 with a reliable seal can be obtained.

Further, since the linear ridge 14 can be formed during the forming process of the half, any additional processes such as a mechanical machining are not necessary. Further more, since it can provide mating surfaces having a high level of air-tightness by the overfolding and compression operation without applying any sealing agent thereto, it is possible to simplify the joining step of the muffler 2. In addition, the manufacturing cost can be reduced since no additional parts, such as a packing material, are required.

Further more, since the linear ridge 14 is strongly compressed against the opposite surface, the good and reliable sealing is ensured along the entire peripheries of the openings 4*a* and 6*a,* whereby any reduction in quality can be prevented.

Although the present invention has been explained in connection the muffler 2 for the purpose of illustration, the method according to the present embodiment may be applicable to join other kinds of parts which require good air tightness, for example, to a joining of a housing halves of an air cleaner or a liquid tank for containing liquid.

Figure 4C:
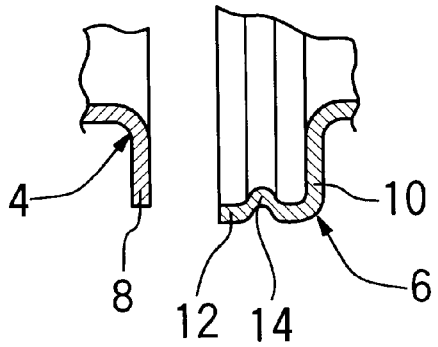
Figure 4D:
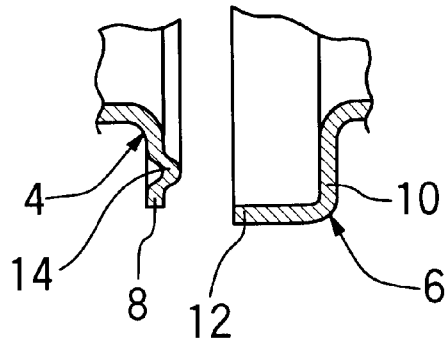
Figure 4E:
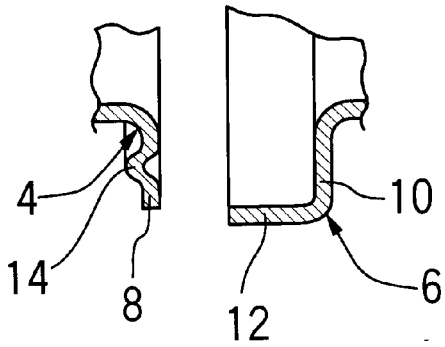

Further, although in this embodiment, the linear ridge 14 is formed on the second flange portion 10, it may be arranged on the first flange portion 8 or the margin portion 12 as shown in FIGS. 4*c*–4*n*. In this case, the linear ridge 14 may be arranged so as to be convex toward the opposite surface in the overfolded state of the margin portion 12 as shown in FIGS. 2 and 4*b*. That is, when the linear ridge 14 is arranged on the first flange portion 8, it may be formed so as to project toward the second flange portion 10 or to project toward a surface of the margin portion 12 in the compressed state. On the other hand, when the linear ridge 14 is arranged on the margin portion 12 as shown in FIG. 4*c,* it may be formed so as to project in the direction toward the surface of the first flange portion 8 facing under the compressed condition, whereby, upon compression, the linear ridge 14 is collapsed by its opposite surface.

Figure 4F:
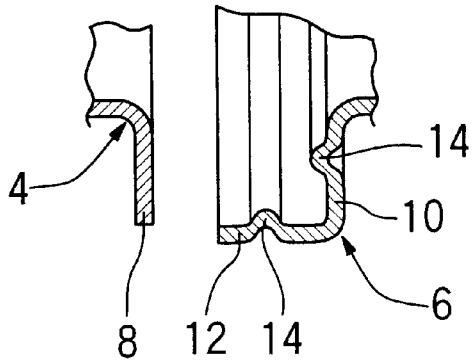
Figure 4G:
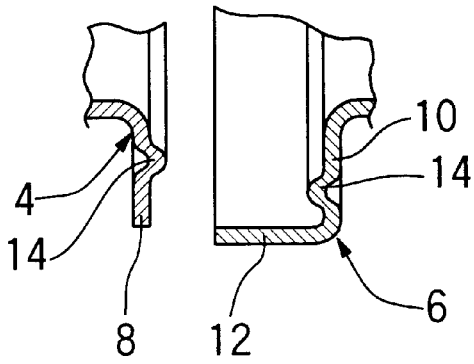
Figure 4H:
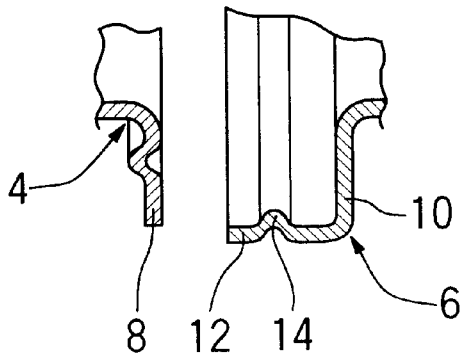
Figure 4I:
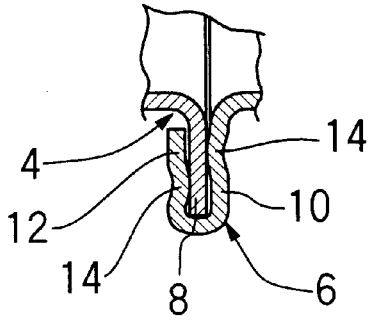
Figure 4J:
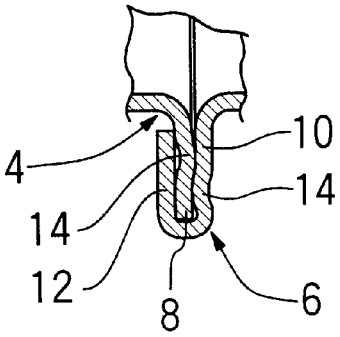
Figure 4K:
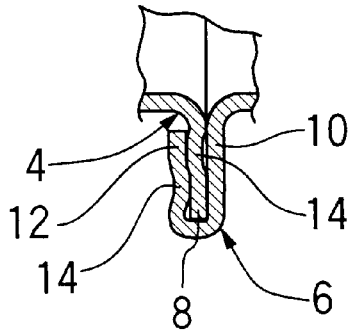

Further, although in this embodiment the linear ridge 14 is arranged only in the second flange portion 10, it my be arranged in two or more portions of the first flange portion 8, the second flange portion 10 and the margin portion 12 as shown in FIGS. 4*f*–4*h*. In such a case, it is desirable that the linear ridges 14 are arranged and spaced from each other, so that the convex portions of the linear ridges 14 facing to each other will not be aligned relative to each other when viewed in a cross-sectional view as shown in FIGS. 4*i*–4*h*. By arranging in that manner, a plurality of sealing barrier walls could be formed in the leak gas passage extending from the interior of the muffler 2 outwardly along the joint surfaces, thus to accomplish greater air tightness.

Figure 4L:
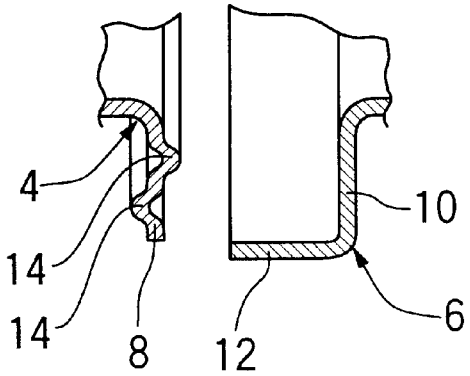
Figure 4M:
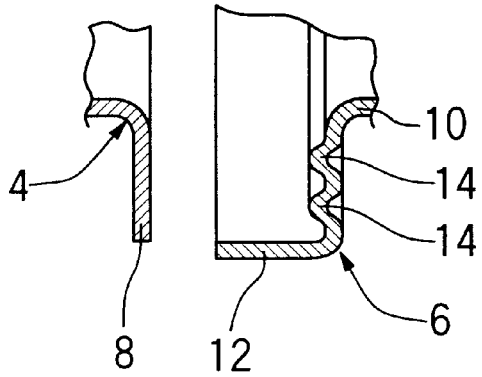
Figure 4N:
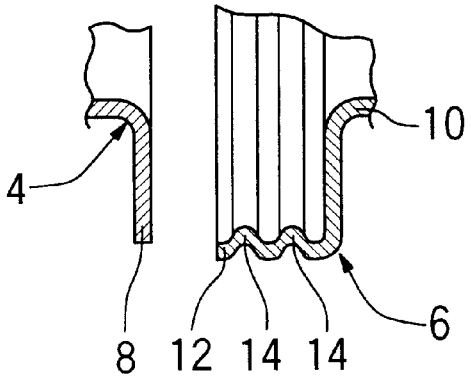

Further, although a single linear ridge 14 is arranged on the second flange portion 10, a plurality of linear ridges 14 may be arranged thereon in parallel to each other as shown in FIGS. 4*l*–4*n*. This configuration, similar to the above case, also can provide a plurality of sealing barrier walls which are disposed in a gas leaking passage, thus a greater air tightness can be obtained.

Yet further, although the linear ridge 14 has a curved surface in its cross-sectional view, other geometrical shapes in the cross-sectional view may be employed so long as it is ridge-shaped with a convex portion projecting toward an opposite surface and with a back surface thereof being a concave shaped. For example, the convex portion may be of a shape with corners or may be formed into a trapezoidal or triangle shape.

Further, although in the present embodiment each of the two halves 4 and 6 is made of metal, one of the halves 4 may be made of another material such as engineering plastic because it has no margin portion requiring bending. In this case, the linear ridge 14 may be arranged on the second flange portion 10 or on the margin portion 12 of the other one of the halves 6.

It is a matter of course that the present invention is not limited to the above embodiment, but various modifications may be made thereto without departing from the spirit and scope of the inventions defined in the attached claims as those modifications would fall within the scope of the present invention.

EFFECT OF THE INVENTION

According to the present invention, there is provided a method for providing a highly sealed joined portion to be made by a reduced number of operating processes and reduced cost without a reduction in resultant quality, and is also provided parts joined by using the same method.

What is claimed is:

1. A unit of joined parts comprising:

a first part and a second part, said first part having a first flange portion extending along an entire periphery thereof, and said second part having a second flange portion extending along an entire periphery thereof and a margin portion extending along an outer edge of said second flange portion; and a preformed linear ridge formed on at least one of said first flange portion, said second flange portion and said margin portion, said preformed linear ridge extending along an entire periphery of the at least one first flange portion, second flange portion and margin portion and extending toward an opposed one of said first flange portion, said second flange portion or said margin portion in an overfolded state;

said unit being formed by matingly contacting said first flange portion with said second flange portion and overfolding said margin portion into contact with at least said first flange portion and plastically deforming said preformed linear ridge by compression so as to form an air-tight seal between the joined parts.

2. The unit as defined in claim 1, wherein the step of overfolding said margin portion includes bringing said margin portion in contact with a back surface of said first flange portion.

3. The unit as defined in claim 1, wherein said preformed linear ridge extends from said second flange portion.

4. The unit as defined in claim 1, wherein said preformed linear ridge extends from said margin portion.

5. The unit as defined in claim 1, wherein said preformed linear ridge extends from said first flange portion towards said second flange portion.

6. The unit as defined in claim 1, wherein said preformed linear ridge extends from said first flange portion towards said margin portion.

7. The unit as defined in claim 1, wherein said at least two preformed linear ridge portions are provided on said at least one of said first flange portion, said second flange portion and said margin portion.

8. The unit as defined in claim 7, wherein said at least two preformed linear ridge portions are provided on one of said at least one of said first flange portion, said second flange portion and said margin portion and extend substantially parallel to one another.

9. A pair of a first part and a second part for joining to each other, comprising:

said first part having a first flange portion extending along an entire periphery thereof said second part having an second flange portion extending along an entire periphery thereof and having a margin portion extending along an outer edge of said second flange portion; and a preformed linear ridge formed on at least one of said first flange portion, said second flange portion and said margin portion, said preformed linear ridge extending along an entire periphery of the at least one first flange portion, second flange portion and margin portion and extending toward an opposed one of said first flange portion, said second flange portion or said margin portion when in an overfolded state, wherein said preformed linear ridge is compressible and plastically deformed upon assembly of said first and second part so as to form an air-tight seal between the two parts.

10. The pair of a first part and a second part as defined in claim 9, wherein the step of overfolding said margin portion includes bringing said margin portion in contact with a back surface of said first flange portion.

11. The pair of a first part and a second part as defined in claim 9, wherein said preformed linear ridge extends from said second flange portion.

12. The pair of a first part and a second part as defined in claim 9, wherein said preformed linear ridge extends from said margin portion.

13. The pair of a first part and a second part as defined in claim 9, wherein said preformed linear ridge extends from said first flange portion towards said second flange portion.

14. The pair of a first part and a second part as defined in claim 9, wherein said preformed linear ridge extends from said first flange portion towards said margin portion.

15. The pair of a first part and a second part as defined in claim 9, wherein at least two preformed linear ridge portions are provided on said at least one of said first flange portion, said second flange portion and said margin portion.

16. The pair of a first part and a second part as defined in claim 15, wherein said at least two preformed linear ridge portions are provided on one of said at least one of said first portion, said second flange portion and said margin portion and extend substantially parallel to one another.

* * * * *